US010623850B2

(12) United States Patent
Muramatsu

(10) Patent No.: US 10,623,850 B2
(45) Date of Patent: Apr. 14, 2020

(54) SPEAKER SYSTEM

(71) Applicant: Yamaha Corporation, Hamamatsu-shi, Shizuoka (JP)

(72) Inventor: Toshihiko Muramatsu, Iwata (JP)

(73) Assignee: Yamaha Corporation, Hamamatsu-shi (JP)

( * ) Notice: Subject to any disclaimer, the term of this patent is extended or adjusted under 35 U.S.C. 154(b) by 334 days.

(21) Appl. No.: 15/688,087

(22) Filed: Aug. 28, 2017

(65) Prior Publication Data

US 2018/0063633 A1 Mar. 1, 2018

(30) Foreign Application Priority Data

Aug. 31, 2016 (JP) ..... 2016-169307

(51) Int. Cl.
*H04R 1/28* (2006.01)
*H04R 1/02* (2006.01)

(52) U.S. Cl.
CPC ..... *H04R 1/2826* (2013.01); *H04R 1/02* (2013.01)

(58) Field of Classification Search
CPC ..... H04R 1/2826; H04R 1/02
USPC ..... 181/156, 148
See application file for complete search history.

(56) References Cited

U.S. PATENT DOCUMENTS 2,787,332 A * 4/1957 Fulmer ..... H04R 1/2857 181/156
5,517,573 A * 5/1996 Polk ..... H04R 1/2826 181/156
5,809,154 A * 9/1998 Polk ..... H04R 1/2826 181/156
5,892,183 A * 4/1999 Roozen ..... H04R 1/2826 181/156
7,011,178 B2 * 3/2006 Morkerken ..... H04R 1/2826 181/144
7,861,825 B2 * 1/2011 Stewart, Jr. ..... H04R 1/2865 181/148

(Continued)

FOREIGN PATENT DOCUMENTS

CN 101547390 A 9/2009
JP 5110012 B2 12/2012

OTHER PUBLICATIONS

English translation of Chinese Office Action issued in counterpart Chinese Application No. 201710756155.1 dated Aug. 5, 2019 (nine pages).

*Primary Examiner* — Forrest M Phillips
(74) *Attorney, Agent, or Firm* — Crowell & Moring LLP

(57) ABSTRACT

A speaker system includes: a speaker unit; a phase-inversion enclosure in which the speaker unit is installed; a bass reflex port that is installed in the phase-inversion enclosure, the bass reflex port having a tubular shape and having an opening, the bass reflex port extending in a first axial direction which is a direction from the opening towards an inside of the bass reflex port, at least a portion of a cross-section of the bass reflex port perpendicular to the first axial direction becoming gradually smaller as going in the first axial direction, and a length of the cross-section in a second axial direction parallel to the cross-section being constant along the first axial direction; and a first flow-regulating plate that is provided near the opening, the first flow-regulating plate having a shape adapted to a flow rate of airflow discharged from the opening or drawn into the opening.

4 Claims, 10 Drawing Sheets

(56) References Cited

U.S. PATENT DOCUMENTS

| | | | | |
|---|---|---|---|---|
| 8,094,853 | B2 * | 1/2012 | Seki | H04R 1/2826 381/337 |
| 8,391,528 | B2 * | 3/2013 | Vercelli | H04R 1/2826 181/156 |
| 8,744,108 | B2 * | 6/2014 | Trainer | H04R 1/2826 181/155 |
| 8,869,931 | B1 * | 10/2014 | Gahimer | H04R 1/2815 181/152 |
| 8,938,084 | B2 * | 1/2015 | Arai | H04B 3/23 181/156 |
| 2004/0017924 | A1 * | 1/2004 | Kuratani | H04R 1/02 381/349 |
| 2005/0087392 | A1 * | 4/2005 | Flanders | H04R 1/26 181/156 |
| 2005/0189164 | A1 * | 9/2005 | Chang | H04R 1/2857 181/152 |
| 2009/0260915 | A1 | 10/2009 | Arai | |
| 2013/0284536 | A1 * | 10/2013 | Ito | H04R 1/2842 181/156 |
| 2014/0262598 | A1 * | 9/2014 | Miki | H04R 1/2815 181/156 |

* cited by examiner

SPEAKER SYSTEM

BACKGROUND OF THE INVENTION

Field of the Invention

The present invention relates to a speaker system.

Priority is claimed on Japanese Patent Application No. 2016-169307, filed Aug. 31, 2016, the content of which is incorporated herein by reference.

Description of Related Art

Conventionally, some of bass-enhancing speaker systems use phase-inversion enclosures. Phase-inversion enclosures include a speaker unit and a bass reflex port installed in a baffle plate that forms the front plate of a cabinet. The bass reflex port has a vent portion formed on the front plate, and a tubular portion that is installed inside the enclosure and connected to the vent portion.

There is proposed a bass reflex port which includes a tubular body having an upper plate and a lower plate that are arranged parallel to each other, such that the cross-sectional area along a direction perpendicular to the upper plate becomes gradually smaller in an axial direction from one opening of the bass reflex port towards the interior of the bass reflex port (for example see Japanese Patent Publication No. 5110012, which is hereinafter referred to as Patent Document 1).

In the structure in Patent Document 1, the cross-sectional area at the opening, which is along the aforementioned direction, is larger than the cross-sectional area at the interior, which is along the aforementioned direction. Therefore, when air is drawn through the opening, the flow rate of the airflow that is pulled into the tubular body becomes slower, and thus turbulence is suppressed at the end portions of the opening. Similarly, when air is discharged through the opening, the flow rate of the airflow becomes slower as approaching the opening, and thus turbulence is suppressed at the end portions of the opening. Furthermore, the spacing between the upper plate and the lower plate forming the tubular body is constant and the inner wall surfaces of the upper plate and the lower plate are smoothly continuous, so turbulence is not generated even if the flow rate of the airflow becomes fast inside the tubular body.

However, even with the bass reflex port in Patent Document 1, the airflow in the central part along the central axis of the tubular body advances straight through and is discharged from the opening without spreading to the end portions of the opening, so the flow rate does not decrease. As a result thereof, wind noise is sometimes generated due to friction between the airflow and the inner wall surfaces of the enclosure in which the bass reflex port is provided.

SUMMARY OF THE INVENTION

The present invention has been made in consideration of the above-mentioned circumstances. An exemplary object of the present invention is to provide a speaker system including a bass reflex port that does not generate or reduces wind noise due to friction between the airflow and the wall surfaces of the enclosure.

A speaker system according to an aspect of the present invention includes: a speaker unit; a phase-inversion enclosure in which the speaker unit is installed; a bass reflex port that is installed in the phase-inversion enclosure, the bass reflex port having a tubular shape and having an opening, the bass reflex port extending in a first axial direction which is a direction from the opening towards an inside of the bass reflex port, at least a portion of a cross-section of the bass reflex port perpendicular to the first axial direction becoming gradually smaller as going in the first axial direction, and a length of the cross-section in a second axial direction parallel to the cross-section being constant along the first axial direction; and a first flow-regulating plate that is provided near the opening, the first flow-regulating plate having a shape adapted to a flow rate of airflow discharged from the opening or drawn into the opening.

DETAILED DESCRIPTION OF THE INVENTION

Hereinbelow, embodiments of the present invention will be explained with reference to the drawings.

First Embodiment

Figure 1A:
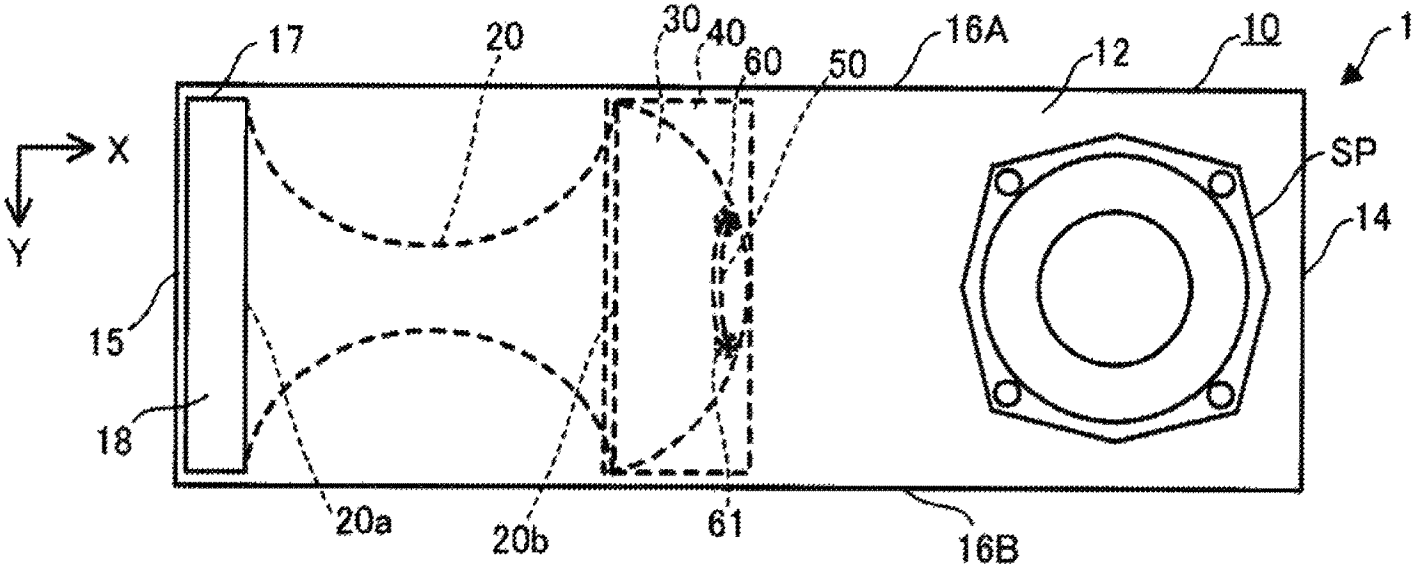
FIG. 1A is a plan view illustrating a speaker system according to a first embodiment of the present invention.
Figure 1B:
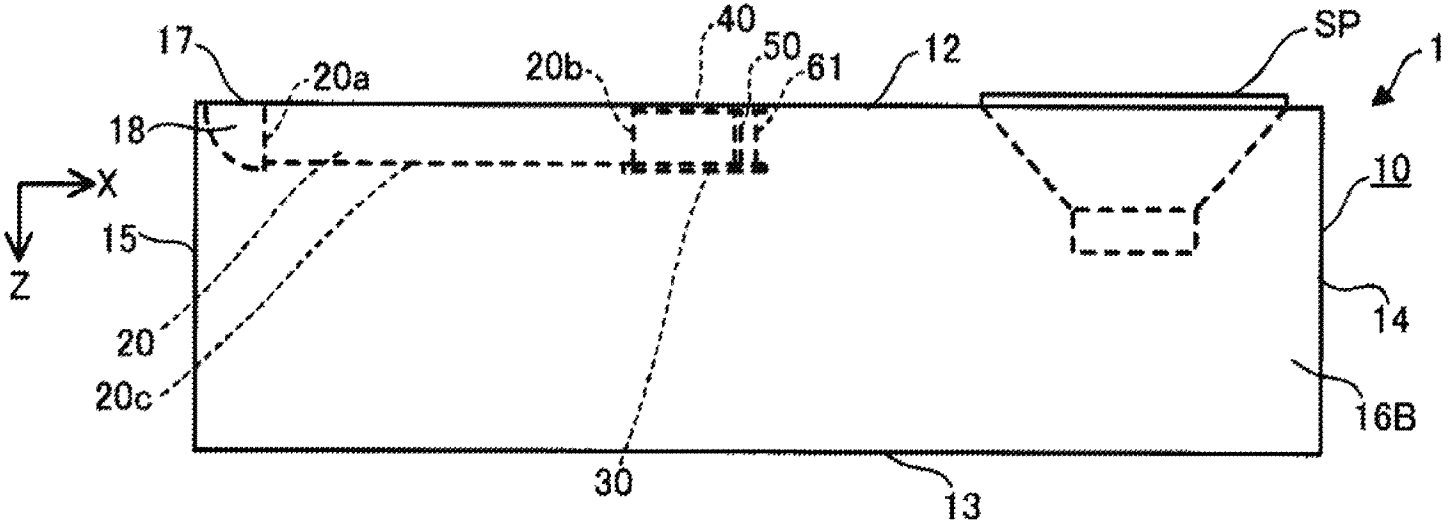
FIG. 1B is a side view illustrating the speaker system according to the first embodiment.

A speaker system according to a first embodiment of the present invention will be explained with reference to the drawings. FIG. 1A is a plan view illustrating a speaker system 1 according to the present embodiment. FIG. 1B is a side view illustrating a speaker system 1 according to the present embodiment.

As shown in FIG. 1A and FIG. 1B, the speaker system 1 includes a phase-inversion enclosure 10, a speaker unit SP, a bass reflex port 20, a first flow-regulating plate 30, a support plate 40, a second flow-regulating plate 50, and flow-regulating members 60, 61.

The enclosure 10 is formed by a front plate 12, a back plate 13, a top plate 14, a bottom plate 15, and a pair of side plates 16A, 16B. The front plate 12 and the back plate 13, the top plate 14 and the bottom plate 15, and the pair of side plates 16A, 16B are mounted so that their main surfaces are parallel to each other. The enclosure 10 in the present embodiment has the shape of a rectangular parallelepiped in which the distance between the top plate 14 and the bottom plate 15 is greater than the distance between the other plates. In the present embodiment, the direction connecting the top plate 14 and the bottom plate 15 shall be referred to as the longitudinal direction (the X direction in FIGS. 1A and 1B), and the direction connecting the side plates 16A, 16B shall be referred to as the lateral direction (the Y direction in FIG. 1A). Additionally, the direction connecting the front plate 12 and the back plate 13 shall be referred to as the depth direction (the Z direction in FIG. 1B).

The speaker unit SP is installed in the front plate 12. The front plate 12 has a bass reflex port vent portion 17 formed therein, and functions as a baffle plate. In the present embodiment, as one example, the speaker unit SP is installed in the front plate 12 near the top plate 14, and the bass reflex port vent portion 17 is formed in the front plate 12 near the bottom plate 15.

The bass reflex port 20 is installed inside the enclosure 10 and has a tubular body allows communication between the inside and the outside of the enclosure 10. In the present embodiment, the bass reflex port 20 is mounted on the inside wall surface of the front plate 12. Of the acoustics that are emitted from the speaker unit SP towards the back surface of the enclosure 10, the bass reflex port 20 enhances the bass-region acoustic components by resonance (Helmholtz resonance). In other words, the enclosure 10 and the bass reflex port 20 form a Helmholtz resonator that has a resonance frequency near the lower-limit frequency of the acoustics emitted from the speaker unit SP towards the front surface of the enclosure 10.

The bass reflex port 20, as illustrated in FIG. 1B, has a length in the depth direction (Z direction) that remains constant along the longitudinal direction (X direction), from the opening 20*b* on the side of the speaker unit SP to the opening 20*a* on the side of the bass reflex port vent portion 17. However, the bass reflex port 20, as illustrated in FIG. 1A, has a shape in which the length in the lateral direction (Y direction) becomes gradually shorter along the longitudinal direction (X direction) from the opening 20*b* towards the central portion of the bass reflex port 20. Additionally, the bass reflex port 20, as illustrated in FIG. 1A, has a shape in which the length in the lateral direction (Y direction) becomes gradually longer along the longitudinal direction (X direction) from the central portion of the bass reflex port 20 towards the opening 20*a*. The present embodiment is not limited to the shape illustrated in FIG. 1B. For example, the length of the bass reflex port 20 in the depth direction (Z direction) need not be constant.

The opening 20*a* of the bass reflex port 20 on the side of the bass reflex port vent portion 17 is connected, via a connecting space portion 18, to the bass reflex port vent portion 17. A first flow-regulating plate 30 is provided near the opening 20*b* of the bass reflex port 20 on the side of the speaker unit SP.

As shown in FIG. 1A, the first flow-regulating plate 30 has a shape, in plan view (when seen in the Z direction), in which one side is a straight line, and the other side is in the shape of an arc having a predetermined radius of curvature or a curve that conforms to an exponential function. The first flow-regulating plate 30 is mounted so that the end portion having the straight side is overlapped with the surface of the bass reflex port 20 on the side of the back plate 13 of the enclosure 10. A rectangular support plate 40 is provided at a position facing the first flow-regulating plate 30 in the depth direction (Z direction). A second flow-regulating plate 50 is provided between the first flow-regulating plate 30 and the support plate 40, and is away from the opening 20*b* by a predetermined distance in the longitudinal direction (X direction). Flow-regulating members 60, 61 are provided on the edges on both sides of the second flow-regulating plate 50. Each of the flow-regulating members 60, 61 has a cylindrical shape with a portion being cut out.

Figure 2:
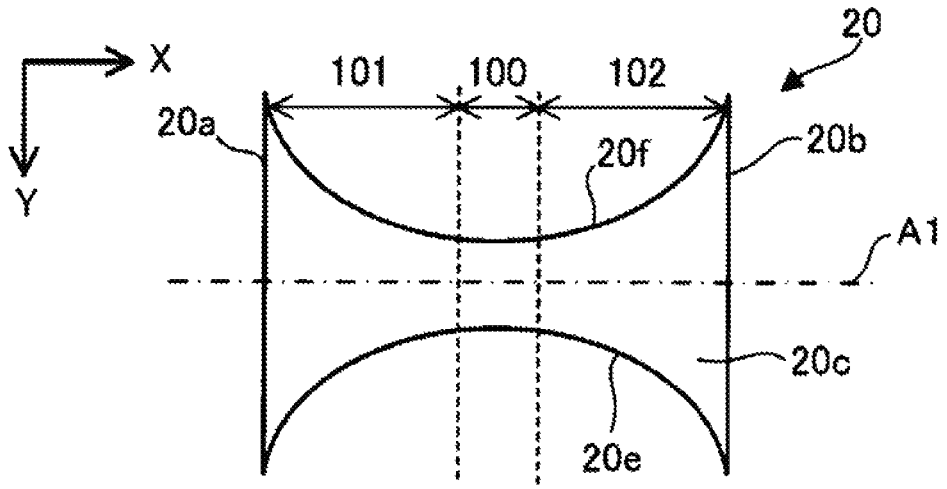
FIG. 2 is a plan view illustrating a bass reflex port of the speaker system.

Next, the bass reflex port 20 of the present embodiment will be explained in detail by referring to FIGS. 2 and 3. FIG. 2 is a plan view illustrating a bass reflex port 20, and FIG. 3 is a perspective view illustrating a bass reflex port 20.

Figure 3:
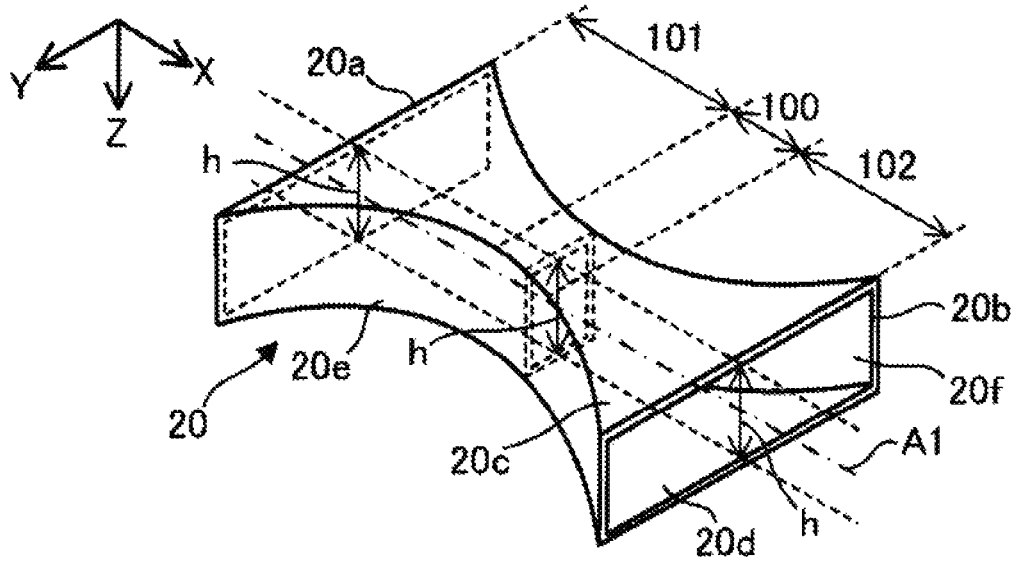
FIG. 3 is a perspective view illustrating the bass reflex port.

As shown in FIGS. 2 and 3, the bass reflex port 20 includes an upper plate 20*c*, a lower plate 20*d*, and a pair of side plates 20*e*, 20*f* The bass reflex port 20 has a tubular body in which a continuous hollow portion is formed from one opening 20*a* to the other opening 20*b*, and includes a main tube portion 100, and air flow-regulating portions 101, 102 respectively connected to both ends of the main tube portion 100 in the longitudinal direction (X direction).

The main tube portion 100 and of the air flow-regulating portions 101, 102 have the central axis A1, which is along the longitudinal direction (X direction). As illustrated in FIG. 3, the hollow portions of the main tube portion 100 and of the air flow-regulating portions 101, 102 all have rectangular cross-sections perpendicular to the central axis A1 (that is, the rectangular cross-sections along the direction perpendicular to the central axis A1). The main tube portion 100 has a rectangular parallelepiped shape in which the cross-sectional area perpendicular to the central axis A1 is constant along the direction of the central axis A1. The length of the main tube portion 100 in the longitudinal direction and the size of the cross-section of the hollow portion are set based on the bass frequency that is to be enhanced by the enclosure 10.

Additionally, the air flow-regulating portion 101 has a shape in which the cross-sectional area of the hollow portion perpendicular to the central axis A1 becomes gradually smaller along a first axial direction from the side of the opening 20*a* towards the main tube portion 100 positioned on the inside of the bass reflex port 20. The first axial direction is along the central axis A1. Additionally, the air flow-regulating portion 102 has a shape in which the cross-sectional area of the hollow portion perpendicular to the central axis A1 becomes gradually smaller along a third axial direction from the side of the opening 20*b* towards the main tube portion 100 positioned on the inside of the bass reflex port 20. The third axial direction is opposite to the first axial direction and is along the central axis A1. In order to obtain such a shape for the air flow-regulating portions 101, 102, the pair of side plates 20*e*, 20*f* are formed so as to be in the shape of arcs having a predetermined radius of curvature or curves that conform to exponential functions in plan view, as shown in FIG. 2.

As shown in FIG. 3, the cross-section of the bass reflex port 20 has a length h. The length h is along a second axial direction which is perpendicular to the upper plate 20*c* and which is parallel to the cross-section of the hollow portion. The length h is constant along the central axis A1, which is along the first axial direction. In other words, in the present embodiment, the distance between the inner wall surface of the upper plate 20*c* and the inner wall surface of the lower plate 20*d* is constant.

By using such a structure, the airflow that is taken into the hollow portion from the opening 20*b* passes through the air flow-regulating portion 102, the main tube portion 100 and the air flow-regulating portion 101, and when the airflow is discharged from the opening 20*a*, it continues to receive pressure from the inner wall surface of the upper plate 20*c* and the inner wall surface of the lower plate 20*d*, the distance between which remains constant. Therefore, the spread of the airflow in the direction of the inner wall surface of the upper plate 20*c* and in the direction of the inner wall surface of the lower plate 20*d* is suppressed, and the airflow spreads in the directions of the inner wall surfaces of the pair of side plates 20*e*, 20*f*, the distance between which gradually widens from the central portion towards the opening 20*b*. The cross-sectional area of the hollow portion perpendicular to the central axis A1 becomes gradually larger from the main tube portion 100 towards the opening 20*b*. As a result thereof, the flow rate of the airflow that is spread in the direction of the inner wall surfaces of the pair of side plates 20*e*, 20*f* gradually decreases towards the opening 20*b*. Due to the aforementioned spreading, the pressure of the air discharged from the opening 20*b* is reduced and almost no turbulence is generated at the opening 20*b*. Therefore, the generation of noise due to the generation of turbulence can be suppressed. The effect whereby the generation of noise is suppressed in this way is similarly achieved when the airflow that is taken into the hollow portion from the opening 20*a* passes through the air flow-regulating portion 101, the main tube portion 100 and the air flow-regulating portion 102, and is discharged from the opening 20*b*.

However, as mentioned above, the airflow that flows along the central axis A1 in the central part of the hollow portion without spreading in the direction of the inner wall surfaces of the pair of side plates 20*e*, 20*f* is discharged from the opening 20*a* or the opening 20*b* without a decrease in flow rate. Similarly, the airflow that flows along the central axis A1 in the central part of the hollow portion is drawn into the opening 20*a* or the opening 20*b* without a decrease in flow rate. As a result thereof, there are cases in which wind noise is generated by the friction between the inner wall surface of the front plate 12 of the enclosure 10 and the airflow discharged from the opening 20*b* on the side of the speaker unit SP, without a decrease in flow rate. This phenomenon similarly occurs when air is drawn through the opening 20*b*.

Therefore, the present embodiment provides an overhanging first flow-regulating plate 30 which covers the opening 20*b* from the side of the upper plate 20*c*. Additionally, a second flow-regulating plate 50 is provided which is away from the opening 20*b* by a predetermined distance in the longitudinal direction (X direction). The second flow-regulating plate 50 covers the gap formed between the first flow-regulating plate 30 and the inner wall surface of the front plate 12. Additionally, cylindrical flow-regulating members 60, 61 are provided on the edge portions of the second flow-regulating plate 50.

Figure 4A:
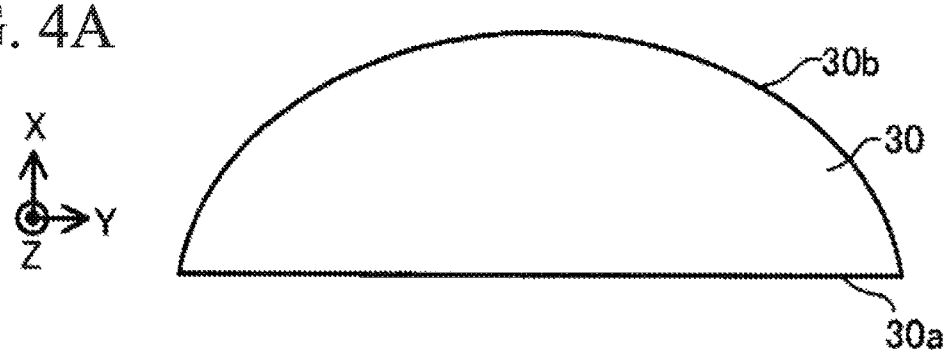
FIG. 4A is a plan view illustrating a first flow-regulating plate of the speaker system.
Figure 4B:
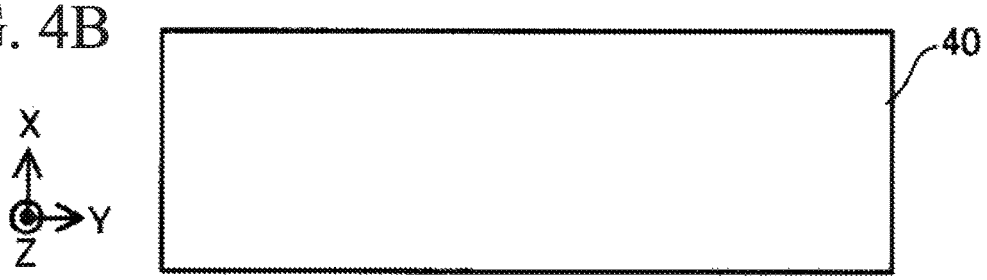
FIG. 4B is a plan view illustrating a support plate of the speaker system.
Figure 4C:
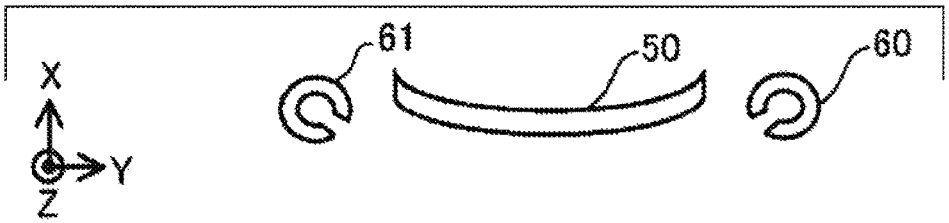
FIG. 4C is a plan view illustrating a second flow-regulating plate and flow-regulating members of the speaker system.
Figure 4D:
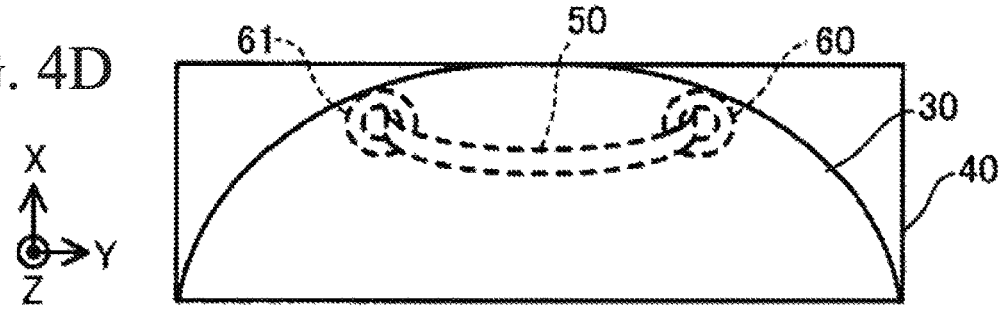
FIG. 4D is a plan view illustrating the first flow-regulating plate, the second flow-regulating plate and the flow-regulating members in an assembled state.
Figure 4E:
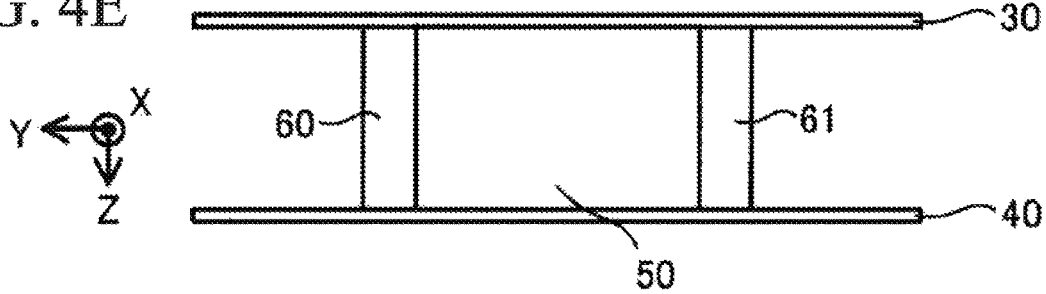
FIG. 4E is a side view showing the first flow-regulating plate, the second flow-regulating plate and the flow-regulating members in an assembled state.
Figure 5:
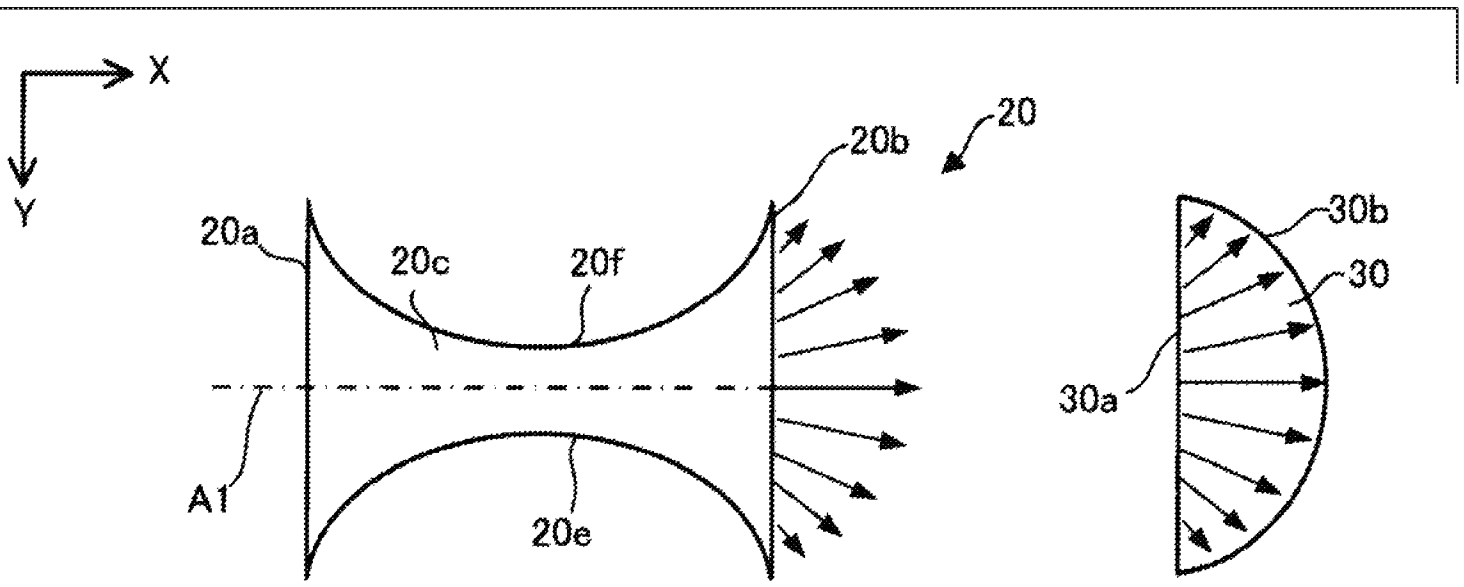
FIG. 5 is a diagram for explaining the relationship between the shape of the first flow-regulating plate and the flow rate of the airflow discharged from the opening of the bass reflex port.
Figure 6:
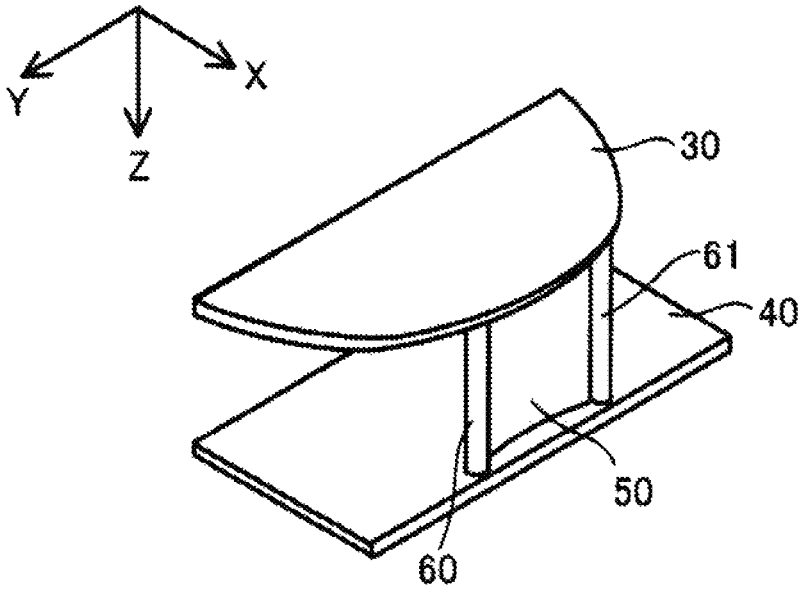
FIG. 6 is a perspective view illustrating the first flow-regulating plate, the second flow-regulating plate and the flow-regulating members in an assembled state.
Figure 7:
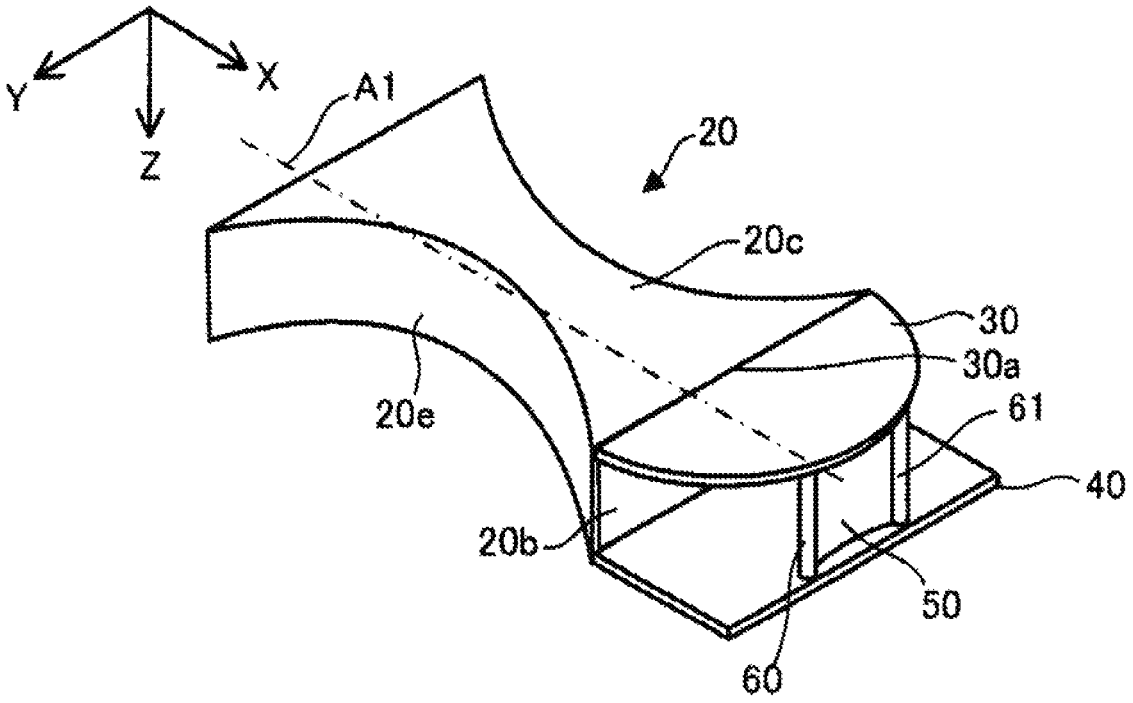
FIG. 7 is a perspective view illustrating the first flow-regulating plate, the second flow-regulating plate and the flow-regulating members in an assembled state and mounted on a bass reflex port.

Next, the first flow-regulating plate 30, the second flow-regulating plate 50 and the flow-regulating members 60, 61 will be explained with reference to FIG. 4A to 7. FIG. 4A is a plan view illustrating the first flow-regulating plate 30. FIG. 4B is a plan view illustrating the support plate 40. FIG. 4C is a plan view illustrating the second flow-regulating plate 50 and the flow-regulating members 60, 61. FIG. 4D is a plan view illustrating the first flow-regulating plate 30, the second flow-regulating plate 50 and the flow-regulating members 60, 61 in an assembled state. FIG. 4E is a side view illustrating the first flow-regulating plate 30, the second flow-regulating plate 50 and the flow-regulating members 60, 61 in an assembled state. FIG. 5 is a diagram for explaining the relationship between the shape of the first flow-regulating plate 30 and the flow rate of the airflow discharged from the opening 20*b*. FIG. 6 is a perspective view showing the first flow-regulating plate 30, the second flow-regulating plate 50 and the flow-regulating members 60, 61 in an assembled state. FIG. 7 is a perspective view illustrating the first flow-regulating plate 30, the second flow-regulating plate 50 and the flow-regulating members 60, 61 in an assembled state and mounted on the bass reflex port 20.

As illustrated in FIGS. 4A and 6, the first flow-regulating plate 30 has one side 30*a* and the other side 30*b*, in plan view. The one side 30*a* is a straight line. The other side 30*b* is in the shape of an arc having a predetermined radius of curvature or a curve that conforms to an exponential function. The first flow-regulating plate 30 has a shape that is adapted to the flow rate of the airflow flowing over the first flow-regulating plate 30. As shown in FIG. 5, the flow rate of the airflow discharged from the opening 20*b* of the bass reflex port 20 is fastest in a central part along the central axis A1, and becomes slower near the inner wall surfaces of the pair of side plates 20*e*, 20*f*. The directions of the arrows in FIG. 5 indicate the directions of discharge of the airflow, and the lengths of the arrows indicate the flow rate of the discharged airflow.

In the present embodiment, as shown in FIG. 5, the first flow-regulating plate 30 is formed so that the distance over which the first flow-regulating plate 30 is in contact with the airflow is shorter for areas corresponding to areas having a slow flow rate, and the distance over which the first flow-regulating plate 30 is in contact with the airflow is longer for areas corresponding to areas having a fast flow rate. In order to achieve such a shape, the other side 30*b* of the first flow-regulating plate 30 is in the shape of an arc having a predetermined radius of curvature or a curve that conforms to an exponential function.

As a result of the first flow-regulating plate 30 having the above-described shape, the flow rate of the airflow from the opening 20*b* is made even by coming into contact with the first flow-regulating plate 30. The flow rate of the airflow that is drawn into the opening 20*b* is also affected so that the flow rate changes between the peripheral parts and the central part by coming into contact with the first flow-regulating plate 30. In other words, by coming into contact with the first flow-regulating plate 30, the flow rate decreases even for airflow that flows along the central axis A1 in the central part of the hollow portion without spreading in the directions of the inner wall surfaces of the pair of side plates 20*e*, 20*f*.

As illustrated in FIGS. 4B and 6, the support plate 40 is in the shape of a rectangle in plan view. In the present embodiment, the support plate 40 is used to mount the second flow-regulating plate 50 to the first flow-regulating plate 30. However, it is possible to omit the support plate 40 if, for example, the first flow-regulating plate 30 and the second flow-regulating plate 50 are integrally molded from a resin or the like.

As illustrated in FIGS. 4C, 4D, 6 and 7, the second flow-regulating plate 50 is a plate-shaped body having a curved shape in a plan view along the depth direction (Z direction). Additionally, the second flow-regulating plate 50, as shown in FIG. 4E, is a rectangular plate-shaped body in a side view along the longitudinal direction (X direction). As shown in FIGS. 4D, 6 and 7, the second flow-regulating plate 50 is provided at a predetermined distance from the opening 20*b* in the direction of the central axis A1, at a position facing the area of the opening 20*b* at which the flow rate of the airflow is the fastest, and a position covering the gap formed between the first flow-regulating plate 30 and the support plate 40. If the first flow-regulating plate 30 and the second flow-regulating plate 50 are integrally molded and the support plate 40 is omitted, then the second flow-regulating plate 50 is provided at a predetermined distance from the opening 20*b* in the direction of the central axis A1 at a position covering the gap formed between the first flow-regulating plate 30 and the inner wall surface of the front plate 12.

The second flow-regulating plate 50 is in the shape of an arc or a curve that conforms to an exponential function, in the plan view shown in FIG. 4C. As illustrated in FIG. 4D, when the second flow-regulating plate 50 is mounted on the first flow-regulating plate 30, the second flow-regulating plate 50 is mounted so as to be convex in the direction opposite to the first flow-regulating plate 30. The airflow from the area of the opening where the flow rate is the fastest comes into contact with the first flow-regulating plate 30, thereby making the speed even, and the advancement towards the speaker unit SP is further deflected by the second flow-regulating plate 50. Additionally, when air is drawn into the opening 20*b*, the advance of the airflow is blocked by the second flow-regulating plate 50, so the air is drawn from the gaps to the left and right of the second flow-regulating plate 50. As a result thereof, there occurs no friction between the inner wall surface of the front plate 12 and the airflow from the area of the opening 20*b* where the flow rate is the fastest, so the generation of wind noise caused by such friction is prevented. Additionally, while the direction of the airflow from the opening 20*b* is changed so as to advance along the second flow-regulating plate 50 and towards the gaps to the left and right of the second flow-regulating plate 50, the generation of wind noise due to the airflow colliding with the second flow-regulating plate 50 is prevented because the second flow-regulating plate 50 has a curved shape as mentioned above.

As illustrated in FIG. 4C, the flow-regulating members 60, 61 are mounted on both edge portions of the second flow-regulating plate 50. Here, the edge portions of the second flow-regulating plate 50 serve as the boundaries with the aforementioned gaps. The flow-regulating members 60, 61 have the shapes of partially cut-out cylinders in the plan view shown in FIG. 4C. By providing the flow-regulating members 60, 61, the airflow is made smoother than in the case in which the airflow directly contacts the edge portions on both sides of the second flow-regulating plate 50. As a result, the generation of wind noise is prevented.

As illustrated in FIGS. 4E and 6, the first flow-regulating plate 30 and the support plate 40 are approximately parallel when the first flow-regulating plate 30, the second flow-regulating plate 50, the flow-regulating members 60, 61 and the support plate 40 are in an assembled state. Additionally, the second flow-regulating plate 50 is approximately perpendicular to the first flow-regulating plate 30 and the support plate 40. The first flow-regulating plate 30, the second flow-regulating plate 50, the flow-regulating members 60, 61 and the support plate 40 can be treated as a single body when they are in the assembled state. Therefore, after the bass reflex port 20 is mounted on the inner wall surface of the front plate 12, the first flow-regulating plate 30 and the like can be mounted on the side of the opening 20*b* of the bass reflex port 20, as shown in FIG. 7. In the present embodiment, as shown in FIG. 1B, the bass reflex port 20 is mounted on the inner wall surface of the front plate 12 so that the top plate 20*c* of the bass reflex port 20 faces the back plate 13 of the enclosure 10.

Figure 8:
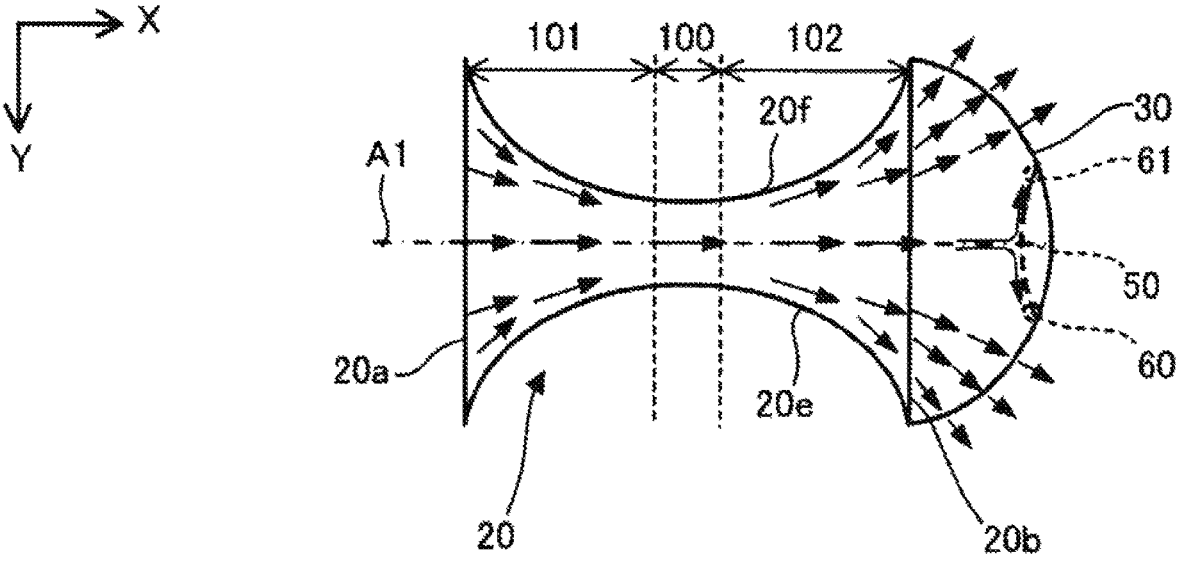
FIG. 8 is a diagram for explaining the movement of airflow that has been drawn into an opening in the bass reflex port, passed through the hollow portion of the bass reflex port, and discharged from an opening in the bass reflex port.
Figure 9:
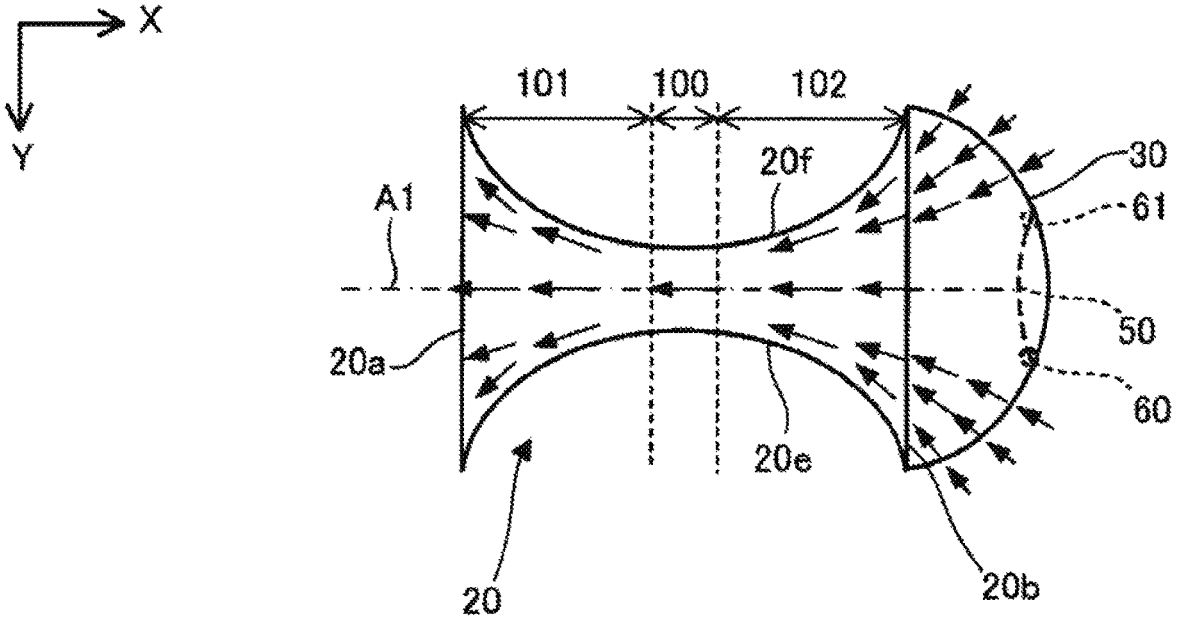
FIG. 9 is a diagram for explaining the movement of airflow that has been drawn into an opening in the bass reflex port, passed through the hollow portion of the bass reflex port, and discharged from an opening in the bass reflex port.

FIG. 8 is a diagram for explaining the movement of airflow when airflow drawn from the opening 20*a* passes through the hollow portion of the bass reflex port 20 and is discharged from the opening 20*b*. FIG. 9 is a diagram for explaining the movement of airflow when airflow drawn from the opening 20*b* passes through the hollow portion of the bass reflex port 20 and is discharged from the opening 20*a*.

As shown in FIG. 8, the air drawn into the hollow portion from the opening 20*a*, when passing through the air flow-regulating portion 101, the main tube portion 100 and the air flow-regulating portion 102, and discharged from the opening 20*b*, is spread towards the inner wall surfaces of the pair of side plates 20*e*, 20*f*, the distance between which gradually spreads towards the opening 20*b*. The cross-sectional area of the hollow portion perpendicular to the central axis A1 becomes gradually larger from the main tube portion 100 towards the opening 20*b*. As a result thereof, the flow rate of the airflow that spreads in the direction of the inner wall surfaces of the pair of side plates 20*e*, 20*f* gradually decreases towards the opening 20*b*. Additionally, the flow rate of the airflow that is spread further decreases by coming into contact with the first flow-regulating plate 30. Additionally, the airflow that has been spread is discharged through the gaps formed on both sides of the second flow-regulating plate 50 as seen from the direction of the central axis A1. Due to this spreading, the pressure of the air discharged from the opening 20*b* is reduced, the flow rate of the airflow is decreased, and the flow rate of the airflow is further decreased by the contact between the airflow and the first flow regulating plate 30, so almost no turbulence is generated in the gaps formed on both sides of the second flow-regulating plate 50. Therefore, the generation of wind noise due to the generation of turbulence can be suppressed. Additionally, the flow regulating members 60, 61 have cylindrical shapes, so they lack corners that collide with the airflow. Therefore, the generation of wind noise that is generated when the airflow hits corners can be suppressed.

Additionally, of the airflow taken into the hollow portion from the opening 20*a*, the flow rate does not decrease for the air that passes along the central axis A1 through the central parts of the flow-regulating portion 101, the main tube portion 100 and the air flow-regulating portion 102. However, the flow rate of the airflow that passes through the central part of the hollow portion and is discharged from the opening 20*b* is decreased by coming into contact with the first flow-regulating plate 30 that has a shape adapted to the flow rate of the airflow, and progress is further blocked by the second flow-regulating plate 50. As a result thereof, friction is not generated between the inner wall surface of the front plate 12 and the airflow that passes along the central part of the hollow portion and is discharged from the opening 20*b*, so the generation of wind noise caused by such friction can be prevented. Furthermore, since the second flow-regulating plate 50 is in the shape of an arc or a curve that conforms to an exponential function, the generation of wind noise due to collisions between the airflow and the second flow-regulating plate 50 can be suppressed.

As shown in FIG. 9, the flow rate of the airflow that is taken in through the gaps formed on both sides of the second flow-regulating plate 50 when viewed from the direction of the central axis A1 is decreased by coming into contact with the first flow-regulating plate 30, so the generation of wind noise can be prevented. Additionally, the flow-regulating members 60, 61 have cylindrical shapes, and thus lack corners that collide with the airflow. Therefore, the generation of wind noise that is generated when airflow collides with the corners can also be suppressed. Additionally, air is taken into the hollow portion through the opening 20*b*, passes through the air flow-regulating portion 102, the main tube portion 100 and the air flow-regulating portion 101, and is discharged from the opening 20*a*. At this time, the airflow spreads in the direction of the inner walls of the pair of side plates 20*e*, 20*f*, the distance between which gradually widens towards the opening 20*a*. The cross-sectional area of the hollow portion perpendicular to the central axis A1 becomes gradually larger from the main tube portion 100 towards the opening 20*a*. As a result thereof, the flow rate of the airflow that is spread in the direction of the inner wall surfaces of the pair of side plates 20*e*, 20*f* is gradually reduced as the air approaches the opening 20*a*. Due to the aforementioned spreading, the pressure of the air discharged from the opening 20*a* is reduced, the flow rate of the airflow decreases, and almost no turbulence is generated at the end portions of the opening 20*a*. Therefore, it is possible to suppress the generation of wind noise that is due to the generation of turbulence.

Additionally, air intake through the central part along the central axis A1 is suppressed by the second flow-regulating plate 50, so friction is not generated between the inner wall surface of the front plate 12 and the airflow that is taken into the central part along the central axis A1 where the flow rate is fastest, thereby preventing the generation of wind noise.

Figure 10A:
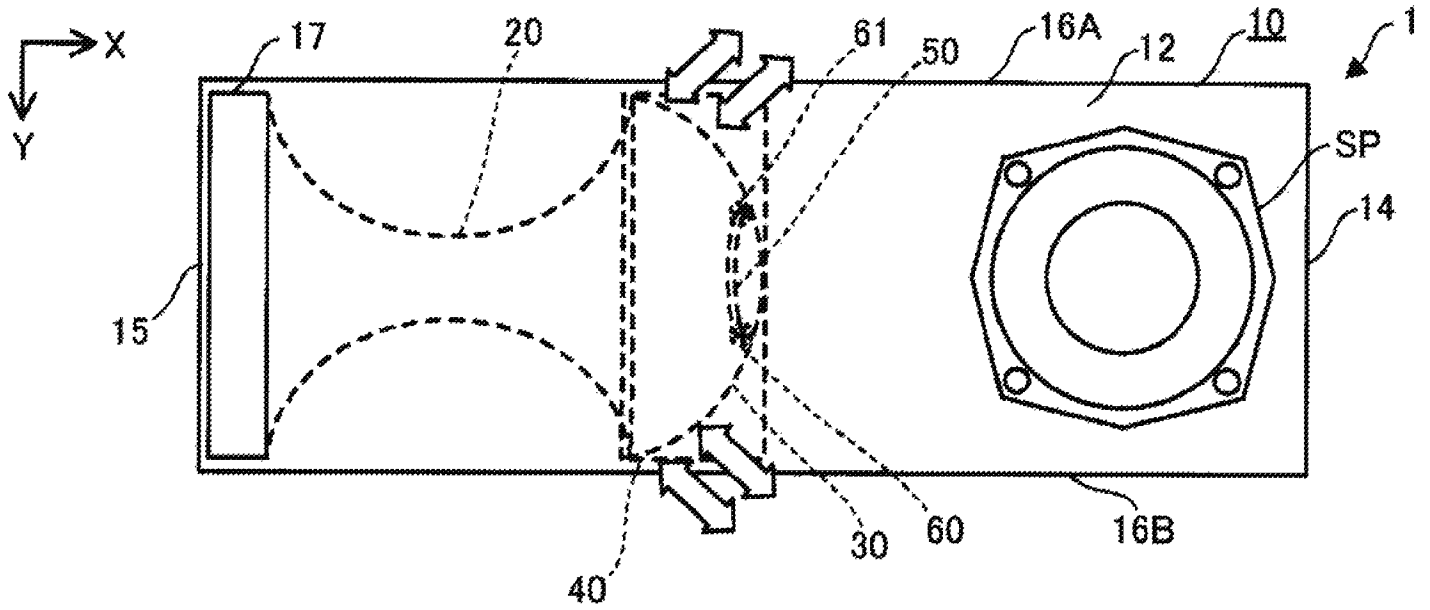
FIG. 10A is a diagram for explaining the directions and flow rates of airflow in the speaker system according to the first embodiment.
Figure 10B:
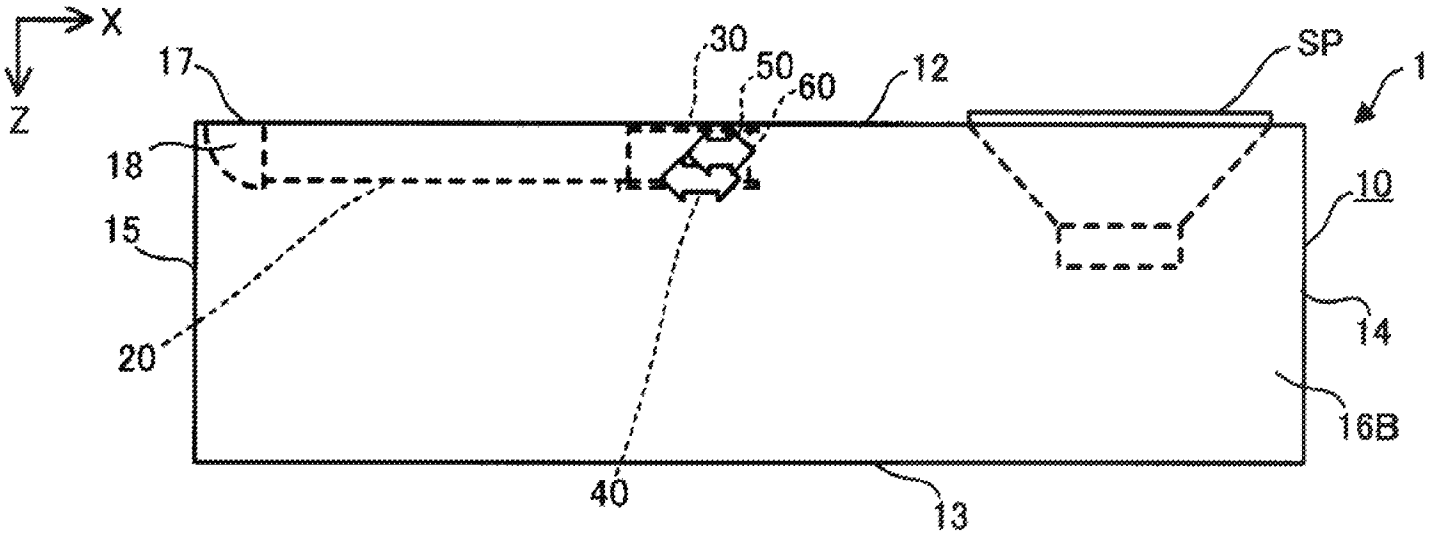
FIG. 10B is a diagram for explaining the directions and flow rates of airflow in the speaker system according to the first embodiment.
Figure 11A:
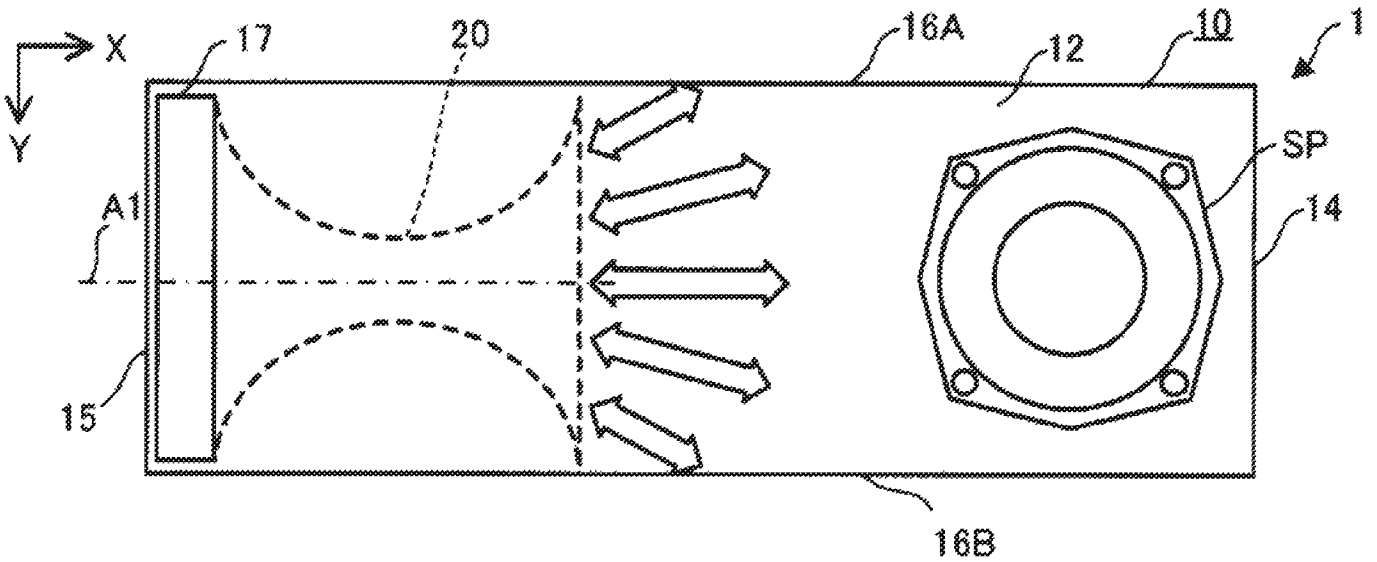
FIG. 11A is a diagram for explaining the directions and flow rates of airflow in the speaker system according to a comparative example.
Figure 11B:
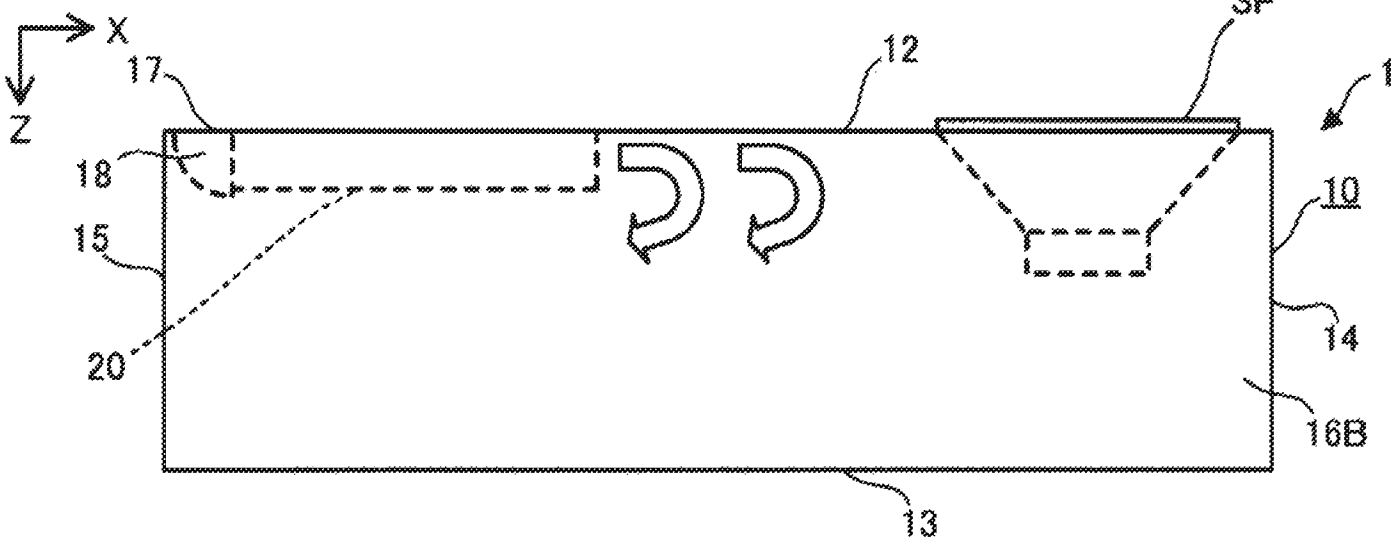
FIG. 11B is a diagram for explaining the directions and flow rates of airflow in the speaker system according to the comparative example.

FIGS. 10A and 10B are diagrams for explaining the direction and flow rate of airflow in the speaker system 1 according to the present embodiment. FIGS. 11A and 11B are diagrams for explaining the direction and flow rate of airflow in a speaker system 1 according to a comparative example.

In the present embodiment, as shown in FIGS. 10A and 10B, the flow rate of the airflow is suppressed due to friction between the air and the first flow-regulating plate 30 and the second flow-regulating plate 50. In FIGS. 10A and 10B, the arrows show the direction of airflow and the flow rate of the airflow. Additionally, the airflow inside the enclosure 10 is regulated by the second flow-regulating plate 50 towards the outsides of the region between the second flow-regulating plate 50 and the speaker unit SP. As a result thereof, turbulence in the airflow due to increased flow rates is reduced, and the generation of unwanted noise due to turbulence in the airflow can be suppressed. Additionally, wind noise due to friction with the inner wall surfaces can be reduced. Furthermore, turbulence in the airflow can also be reduced by the flow-regulating members 60, 61, so the generation of unwanted noise due to turbulence in the airflow can be suppressed.

On the other hand, in the comparative example shown in FIGS. 11A and 11B, a first flow-regulating plate 30, a second flow-regulating plate 50 and flow-regulating members 60, 61 are not provided. In this case, as shown in FIG. 11A, of the airflow along the inner wall surface of the front plate 12 in the enclosure 10, the flow rate of the airflow is fast in the central part along the central axis A1 of the bass reflex port 20. In FIGS. 11A and 11B, the arrows indicate the direction of the airflow and the flow rate of the airflow. As a result thereof, as shown in FIG. 11B, the airflow is made turbulent by the friction between the air and the inner wall surface of the front plate 12, and wind noise is generated.

As described above, according to the present embodiment, a first flow-regulating plate 30, a second flow-regulating plate 50 and flow-regulating members 60, 61 are provided, so it is possible to suppress noise that is generated in the bass reflex port, which is shaped so that the area of the cross-section perpendicular to the central axis becomes gradually larger from the central portion to the openings. Additionally, the structures of the first flow-regulating plate 30, the second flow-regulating plate 50 and the flow-regulating members 60, 61 are simple, and the noise that is generated in the bass reflex port of the comparative example can be suppressed by means of such a simple structure. Furthermore, according to the present embodiment, even if there are obstacles such as grills or the like or the inner wall surfaces of the enclosure 10 in the vicinity of the openings of the bass reflex port, collisions between such obstacles and air can be suppressed, and thereby the generation of noise caused by collisions is suppressed. Therefore, other elements forming the enclosure 10 can be arranged in the vicinity of the bass reflex port. Due thereto, the shape of the enclosure 10 can be made more compact. As a result thereof, a compact speaker system having low noise and enhanced bass can be realized by using a simple structure.

Second Embodiment

Figure 12A:
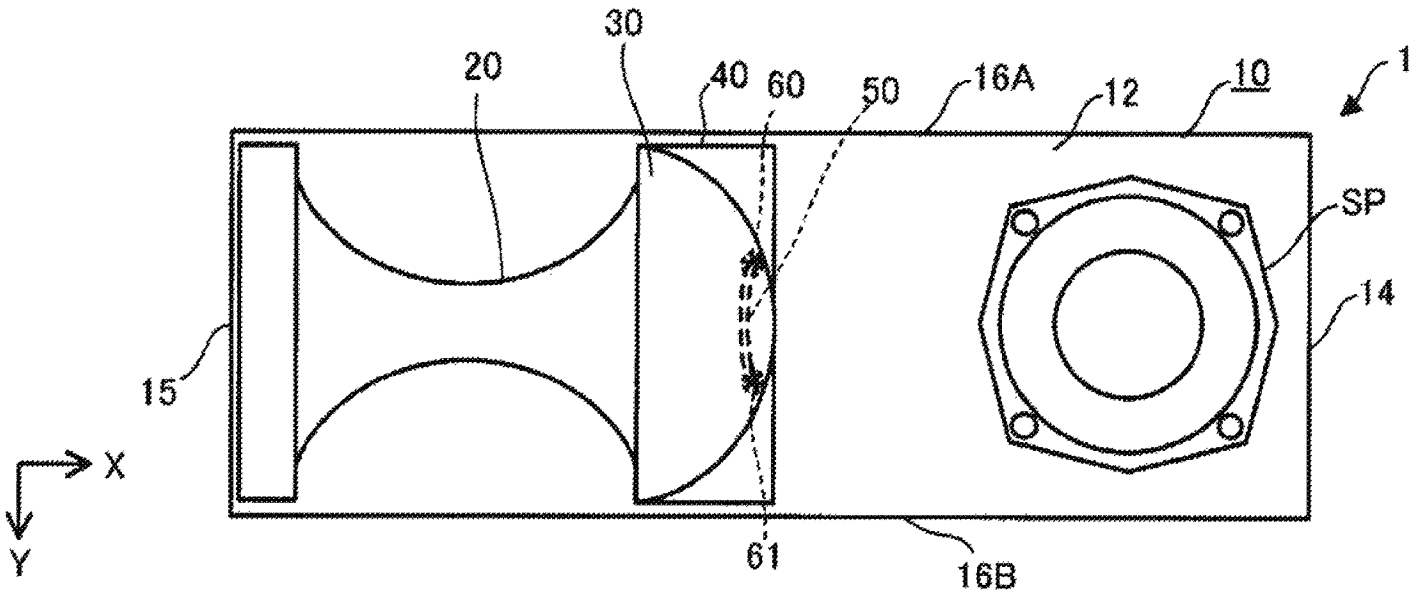
FIG. 12A is a plan view illustrating a speaker system according to a second embodiment.
Figure 12B:
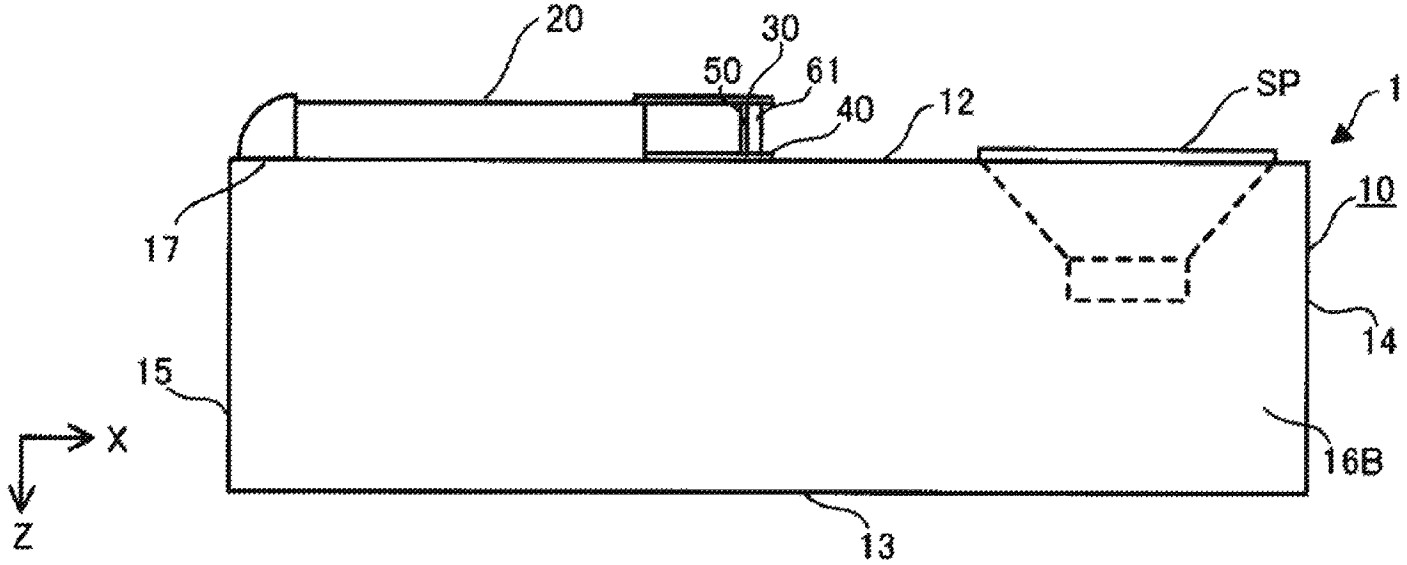
FIG. 12B is a side view illustrating the speaker system according to the second embodiment.

Next, a second embodiment of the present invention will be explained with reference to FIGS. 12A and 12B. FIG. 12A is a plan view illustrating the speaker system 1 according to the present embodiment. FIG. 12B is a side view illustrating the speaker system 1 according to the present embodiment.

In the first embodiment, the bass reflex port 20, the first flow-regulating plate 30, the second flow-regulating plate 50 and the flow-regulating members 60, 61 are provided on the inner wall surface of the front plate 12. However, in the present embodiment, as shown in FIGS. 12A and 12B, the bass reflex port 20, the first flow-regulating plate 30, the second flow-regulating plate 50 and the flow-regulating members 60, 61 are provided on the outer wall surface of the front plate 12.

The present embodiment is also able to suppress noise generated in the bass reflex port having a shape in which the area of the cross-section perpendicular to the central axis becomes gradually larger from the central portion towards the openings, by means of the first flow-regulating plate 30, the second flow-regulating plate 50 and the flow-regulating members 60, 61. Additionally, the structures of the first flow-regulating plate 30, the second flow-regulating plate 50 and the flow-regulating members 60, 61 are simple, and the noise generated in the bass reflex port can be suppressed by such a simple structure. Therefore, a compact speaker system having low noise and enhanced bass can be realized by using a simple structure.

Furthermore, according to the present embodiment, side plates of the enclosure 10 are not present around the gaps on both sides of the second flow-regulating plate 50 through which the airflow is discharged or through which the airflow is drawn, so it is also possible to suppress the generation of wind noise due to friction or collisions between the air and the side plates. Therefore, a bass-enhanced compact speaker system having even less noise than the first embodiment can be realized by using a simple structure.

MODIFICATION EXAMPLES

The present invention is not limited to the above-described embodiments, and for example, the various modifications mentioned below are possible. Additionally, one or more of the following modified embodiments described below may be arbitrarily chosen and combined as appropriate.

Modification Example 1

Figure 13:
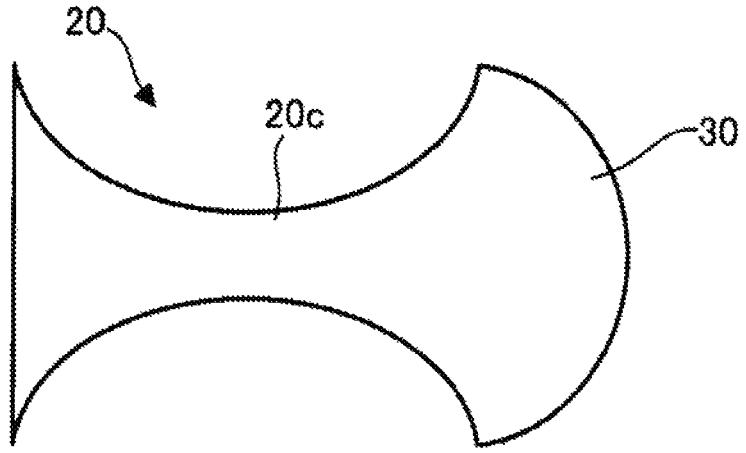
FIG. 13 is a plan view illustrating an upper surface plate of a bass reflex port having an integrally molded first flow-regulating plate according to a modification example.

In the above-described embodiments, the bass reflex port 20 and the first flow-regulating plate 30 and the like are provided as separate elements. Alternatively, the upper plate 20*c* of the bass reflex port 20 and the first flow-regulating plate 30 may be molded integrally, as shown in FIG. 13. FIG. 13 is a plan view illustrating the upper plate 20*c* of the bass reflex port 20 which is integrally molded with the first flow-regulating plate 30 in the present modification example. Furthermore, the upper plate 20*c* and the first flow-regulating plate 30 may also be integrally molded with the second flow-regulating plate 50 and the flow-regulating members 60, 61. When the first flow-regulating plate 30, the second flow-regulating plate 50 and the flow-regulating members 60, 61 are integrally molded, the support plate 40 explained in the above-described embodiments may be omitted.

Modification Example 2

In the above-described embodiments, the shape of the cross-section perpendicular to the central axis A1 in the hollow portion of the bass reflex port 20 is made rectangular. However, the present invention is not limited to such an embodiment, and the shape may be polygonal, circular, elliptical or oval. In this case, if the shape is polygonal, it is more effective to use a shape in which the corners are chamfered.

Modification Example 3

In the above-described embodiments, the bass reflex port vent portion 17 is formed in the front plate 12 near the bottom plate 15, but the present invention is not limited to such a form. For example, the bass reflex port vent portion 17 may be formed near the speaker unit SP. In this case, the first flow-regulating plate 30, the second flow-regulating plate 50 and the flow-regulating members 60, 61 may be provided near the bottom plate 15.

Modification Example 4

In the above-described embodiments, flow-regulating members 60, 61 are applied to the edges of the second flow-regulating plate 50, but the present is not limited to such a form. Instead of applying flow-regulating members 60, 61, the edges of the second flow-regulating plate 50 may have rounded shapes lacking corners. In this case also, the airflow is made smooth, and it is possible to prevent the generation of wind noise.

A speaker system according to an embodiment of the present invention includes: a speaker unit; a phase-inversion enclosure in which the speaker unit is installed; a bass reflex port that is installed in the phase-inversion enclosure, the bass reflex port having a tubular shape and having an opening, the bass reflex port extending in a first axial direction which is a direction from the opening towards an inside of the bass reflex port, at least a portion of a cross-section of the bass reflex port perpendicular to the first axial direction becoming gradually smaller as going in the first axial direction, and a length of the cross-section in a second axial direction parallel to the cross-section being constant along the first axial direction; and a first flow-regulating plate that is provided near the opening, the first flow-regulating plate having a shape adapted to a flow rate of airflow discharged from the opening or drawn into the opening. According to this speaker system, in the central part along the central axis of the tubular body, the airflow that is discharged from the bass reflex port is discharged straightly and flows at a fast speed. Similarly, in the central part along the central axis of the bass reflex port, the airflow that is drawn into the bass reflex port is drawn in straightly and flows at a fast speed. However, there is provided a first flow-regulating plate near the opening, and the first flow-regulating plate has a shape adapted to the flow rate at the opening. Therefore, the speed of the airflow that is discharged from the bass reflex port or the airflow that is drawn into the bass reflex port is reduced by the first flow-regulating plate, and thus the generation of wind noise due to friction with the wall surfaces in the phase-inversion enclosure is suppressed.

The speaker system according to the embodiment of the present invention may further includes a second flow-regulating plate that is provided at a position facing the opening in an area where the flow rate of the airflow is fastest, the second flow-regulating plate being away from the one opening by a predetermined distance, the second flow-regulating plate covering a gap formed between the first flow-regulating plate and a front plate of the bass reflex port. According to this speaker system, in a central part along the central axis of the bass reflex port, the airflow discharged from the bass reflex port is discharged straightly and flows at a fast speed. Additionally, in a central part along the central axis of the bass reflex port, the airflow that is drawn into the tubular body is drawn straightly in and flows at a fast speed. However, the second flow-regulating plate is provided at a position facing the opening in the above-mentioned area in which the flow rate of the airflow is the fastest. Therefore, the advance of airflow having the fastest flow rate is deflected by the second flow-regulating plate, and the generation of wind noise due to friction between the airflow having the fastest flow rate and the wall surfaces of the phase-inversion enclosure is suppressed.

In the speaker system according to the embodiment of the present invention, the bass reflex port may include an air flow-regulating portion that extends from an inside of the bass reflex port towards the opening. The air flow-regulating portion may have a shape in which a width in a direction perpendicular to the first axial direction gradually widens as going from the inside of the bass reflex port toward the opening, the shape being conforming to an exponential function or to a predetermined radius of curvature. The first flow-regulating plate may has one side having a shape corresponding to the shape of the air flow-regulating portion, and the shape of the one side may be a shape of an arc that conforms to the exponential function or to the predetermined radius of curvature. According to this speaker system, the one side of the first flow-regulating plate has a shape corresponding to the shape of the air flow-regulating portion, and the shape of the one side is a shape of an arc that conforms to the exponential function or to the predetermined radius of curvature. Therefore, the flow rate of the airflow that is discharged from the bass reflex port or that is drawn into the bass reflex port is made even. As a result thereof, the flow rate is decreased even in the area where the flow rate of the airflow is the fastest, and the generation of wind noise due to friction between the airflow and the wall surfaces of the phase-inversion enclosure can be suppressed.

The speaker system according to the embodiment of the present invention may further includes: flow-regulating members provided on both edges of the second flow-regulating plate that serve as boundaries with the gap, the flow-regulating members having arc-shaped cross-sections parallel to the first flow-regulating plate. According to this speaker system, there are no corner parts on the edge portions due to the presence of the flow-regulating members, so turbulence is not generated due to collisions between the airflow and corner parts. As a result thereof, the generation of wind noise caused by turbulence is suppressed.

In the speaker system according to the embodiment of the present invention, the bass reflex port may be installed on an inner wall surface of a front plate of the bass reflex port. According to this speaker system, it is possible to suppress the generation of wind noise due to friction between the inner wall surface of the front plate and the airflow that is discharged from the opening in the bass reflex port or the airflow that is drawn into the opening in the bass reflex port.

In the speaker system according to the embodiment of the present invention, the bass reflex port may be installed on an outer wall surface of a front plate of the bass reflex port. According to this speaker system, it is possible to suppress the generation of wind noise due to friction between the outer wall surface of the front plate and the airflow that is discharged from the opening in the bass reflex port or the airflow that is drawn into the opening in the bass reflex port.

While the embodiments of the invention have been described and illustrated above, the present invention is not limited to the above embodiments. Various modifications can be made without departing from the scope of the present invention.

What is claimed is:

1. A speaker system comprising:

a speaker unit;

a phase-inversion enclosure that includes a front plate in which the speaker unit is installed, the front plate having an opening;

a bass reflex port that is installed in the phase-inversion enclosure, the bass reflex port comprising a tubular body, the tubular body having a tubular shape and having first and second openings, the tubular body extending in a first axial direction which is a direction from the first opening towards an inside of the tubular body, an area of at least a portion of a cross-section of the tubular body perpendicular to the first axial direction becoming gradually smaller as going in the first axial direction, and a length of the cross-section in a predetermined second axial direction parallel to the cross-section being constant along the first axial direction, the tubular body comprising a flat plate that has a flat surface perpendicular to the predetermined second axial direction, one side of the flat plate defining an edge of the first opening;

a first flow-regulating plate that is provided near the first opening, the first flow-regulating plate having a shape adapted to a flow rate of airflow discharged from the first opening or drawn into the first opening; and a connecting space portion that connects the second opening to the opening of the front plate, wherein one side of the first flow-regulating plate has a shape of an arc that conforms to an exponential function or to a predetermined radius of curvature, wherein the bass reflex port is installed on an inner surface of the front plate or an outer surface of the front plate, wherein the first axial direction is parallel to the inner surface or the outer surface, and wherein the first flow-regulating plate is provided near the one side of the flat plate, and the first flow-regulating plate is parallel to the flat plate.

2. The speaker system according to claim 1, further comprising:

a second flow-regulating plate that is provided at a position facing the first opening in an area where the flow rate of the airflow is fastest, the second flow-regulating plate being away from the first opening by a predetermined distance, the second flow-regulating plate covering a gap formed between the first flow-regulating plate and the front plate of the bass reflex port.

3. The speaker system according to claim 2, wherein the second flow-regulating plate is convex in a direction towards the first opening, and the second flow-regulating plate has a shape of an arc or a shape of a curve that conforms to an exponential function.

4. The speaker system according to claim 3, further comprising:

flow-regulating members provided on both edges of the second flow-regulating plate that serve as boundaries with the gap, the flow-regulating members having arc-shaped cross-sections parallel to the first flow-regulating plate.

* * * * *